United States Patent [19]

Oatman

[11] Patent Number: 5,022,185

[45] Date of Patent: Jun. 11, 1991

[54] GATE PULLEY GUARD

[76] Inventor: Dean K. Oatman, P.O. Box 475, Adkins, Tex. 78101

[21] Appl. No.: 470,301

[22] Filed: Jan. 25, 1990

[51] Int. Cl.[5] ..... E05D 15/06

[52] U.S. Cl. ..... 49/425; 49/404

[58] Field of Search ..... 49/404, 425–427, 49/460; 16/86.1, 91, 95 R, 96 R

[56] References Cited

U.S. PATENT DOCUMENTS

| | | | |
|---|---|---|---|
| 771,766 | 10/1904 | Burkholder | 16/97 X |
| 1,193,171 | 8/1916 | Mathews | 16/91 |
| 1,356,005 | 10/1920 | O'Conner | 16/97 X |
| 3,106,000 | 10/1963 | Beauchamp | 49/426 X |
| 3,613,314 | 10/1971 | Ford | 49/425 |
| 3,619,947 | 11/1971 | Burum | 49/425 |
| 3,861,084 | 1/1975 | Ford | 49/404 X |
| 4,109,847 | 8/1978 | Bailey | 49/426 X |
| 4,628,638 | 12/1986 | Elko et al. | 49/425 X |
| 4,723,374 | 2/1988 | Peterson et al. | 49/404 |

*Primary Examiner*—Philip C. Kannan
*Assistant Examiner*—Jerry Redman
*Attorney, Agent, or Firm*—Jackson & Walker

[57] ABSTRACT

A pulley guard for a slidable fence gate having elongated horizontal rods supported on a plurality of pulleys rotatably mounted on fixed horizontal stub shafts, comprises a housing surrounding the pulley and preventing inadvertant finger access to the periphery of the pulley. Appropriate notches are provided in the walls of the housing to provide clearance for the stub shaft and for the elongated horizontal gate rod with which the pulley cooperates.

2 Claims, 2 Drawing Sheets

GATE PULLEY GUARD

BACKGROUND OF THE INVENTION

1. FIELD OF THE INVENTION

The invention relates to a guard for pulleys employed to support large industrial type sliding gates.

2. SUMMARY OF THE PRIOR ART

Large sliding gates are commonly employed in fences enclosing industrial or commercial complexes. Such gates are often not wide enough to permit two trucks to enter the gate concurrently, and accordingly, are of substantial weight. It is customary to support such gates by providing on the top and bottom edges of the gate structure, elongated supporting rods which respectively cooperate with the plurality of supporting pulleys which are rotatably mounted on horizontal stub shafts which are secured to horizontally spaced fixed gate posts.

There have been repeated instances where, due to distortion of the gates by minor accidents or by differential sinkage of one or more of the gates supporting posts, one of the supporting rods after a period of use can ride off one or more of the supporting pulleys and render the gate inoperative. Even more importantly, there have been repeated instances where the gate operator, or a spectator, has his hands resting on the supporting rod as the gate is opened or closed and his fingers are caught between a pulley and a cooperating supporting rod, resulting in a crushing injury.

Despite the fact that these problems have existed for many years, there has yet to appear on the market a protective housing for sliding gate pulleys that will overcome the aforementioned problems.

SUMMARY OF THE INVENTION

Sliding gates of the industrial type are normally supported by elongated rods respectively forming the top and bottom edges of such gates and cooperating with the peripheries of grooved pulleys which are respectively mounted on horizontal stub shafts rigidly secured to horizontally spaced, fixed vertical posts. A safety guard embodying this invention comprises a housing having a generally inverted U-shaped overall configuration with an open bottom end. Such housing includes two horizontally spaced, vertical side walls which respectively lie adjacent to the two sides of the respective pulley around which the housing is mounted. A peripheral wall is provided on the housing which interconnects the two side walls and overlies not only the top portions of the pulley but extends vertically downwardly to a region below the lowest part of the respective pulley. This necessarily means that the opposed vertical ends of the housing wall must be provided with vertical slots to surround the supporting rod. Additionally, the side wall of the housing lying intermediate the pulley and the supporting post is provided with an open bottom vertical slot to surround the horizontal stub shaft supporting the pulley.

With the aforedescribed construction, inadvertent contact of the fingers of the operator or a spectator with the pulley as the gate is being operated is prevented. Since each pulley is normally provided with a grease fitting in its hub portion, a small hole is provided in the outer side wall adjacent to the hub of the pulley to permit the insertion of a grease gun nozzle through the hole to engage the grease gun fitting commonly provided on the pulley hub. Thus, the pulley guard does not interfere with the proper maintenance of the pulley bearing.

Not only does the aforedescribed pulley guard substantially eliminate the possibility of injury to the gate operator or spectators, but it also prevents the upper supporting rod from inadvertently becoming dislodged from a pulley in the event that the supporting rod becomes deformed, requiring a time consuming delay to move a crane in place to lift the heavy gate back into proper position on the pulleys.

Further objects and advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
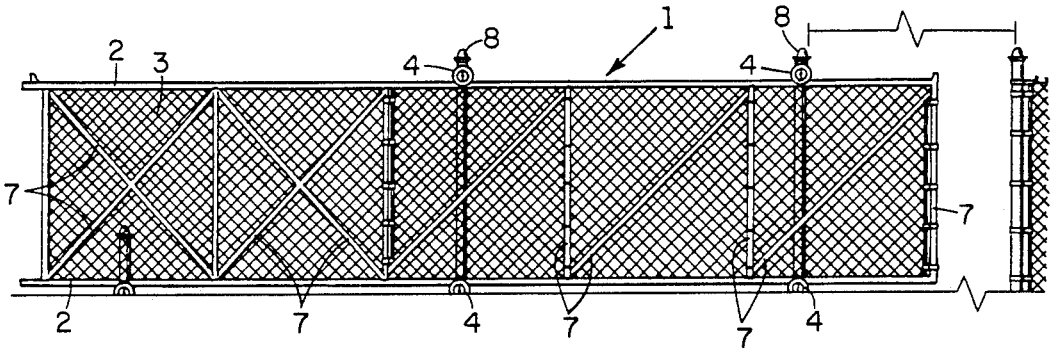
FIG. 1 (PRIOR ART)
FIG. 1 is a reduced scale perspective view of a prior art sliding gate fence wherein elongated support rods on the fence engage a plurality of supporting pulleys mounted on stub shafts secured to vertically fixed posts.
Figure 3:
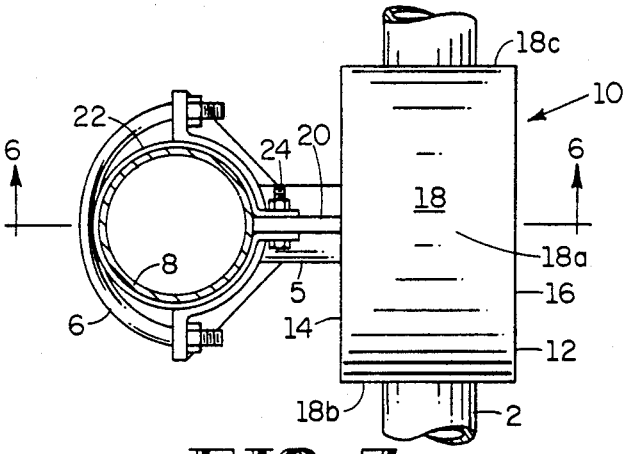
FIG. 3 is a top elevational view of a pulley guard embodying this invention shown in assembled relation to a gate pulley.
Figure 2:
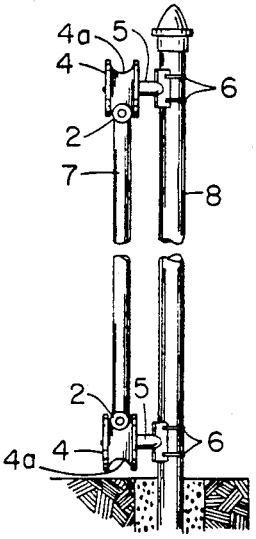
FIG. 2 (PRIOR ART)
FIG. 2 is an end view of the gate of FIG. 1.
Figure 4:
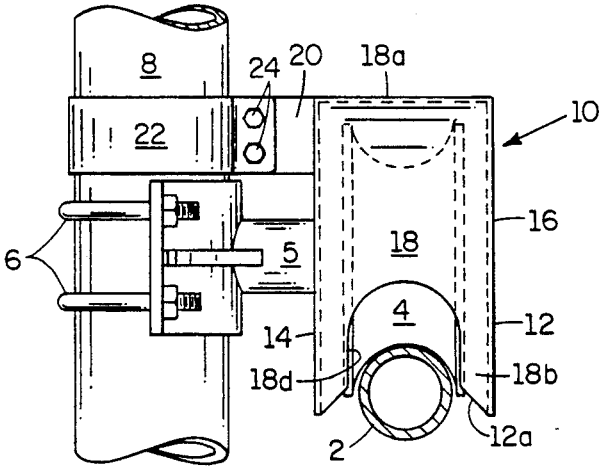
FIG. 4 is a side elevational view of FIG. 3.
Figure 5:
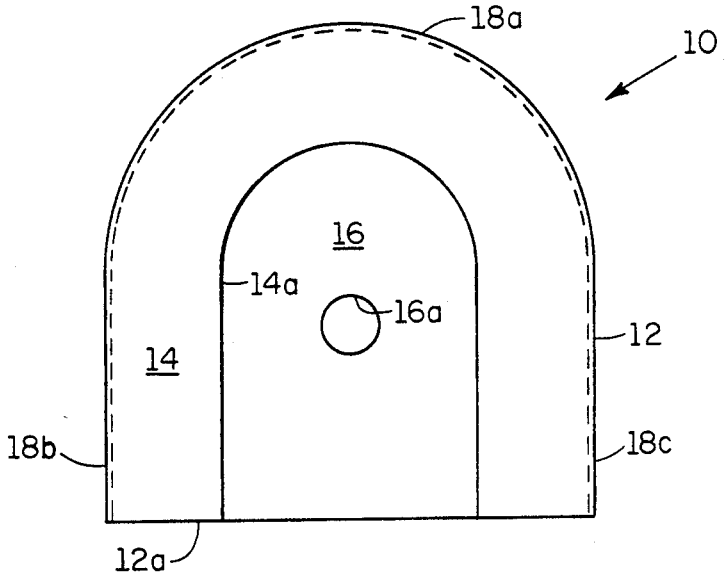
FIG. 5 is a rear elevational view of the pulley guard.
Figure 6:
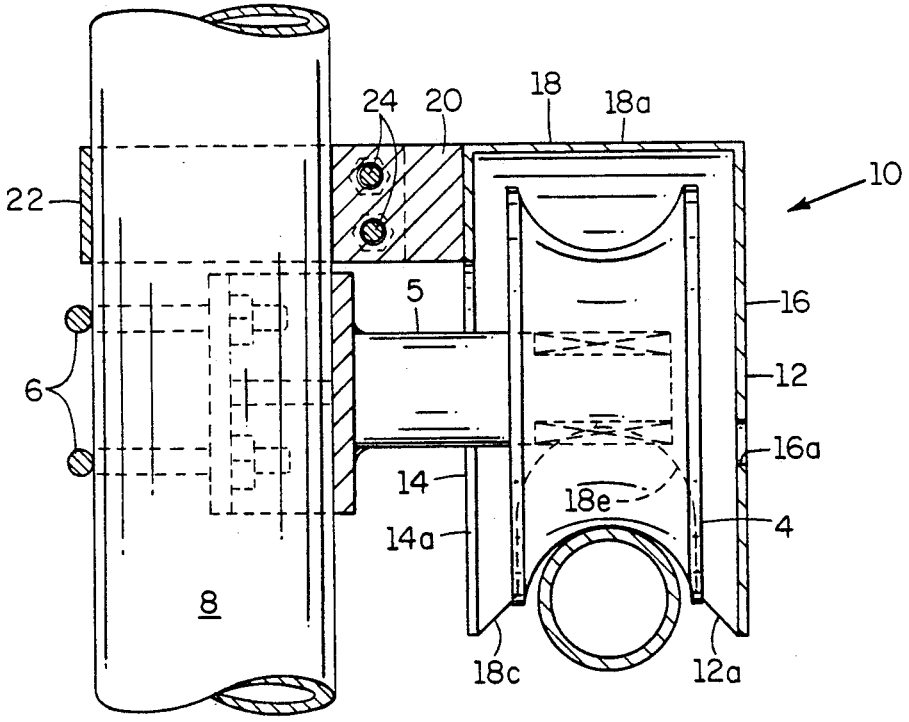
FIG. 6 is an enlarged scale sectional view taken on the plane 6—6 of FIG. 4.

Referring to FIGS. 1 and 2 there is shown a prior art industrial type gate 1 having elongated horizontal support rods 2 mounted to the top and bottom ends of the gate fencing 3. Support rods 2 are respectively mounted to cooperate with the grooved periphery 4*a* of supporting pulleys 4 which are respectively mounted on horizontal stub shafts 5 which are rigidly secured by clamps 6 to fixed support posts 8. The elongated support rods 2 are, of course, connected by vertical and diagonal rods 7.

The lower support rod 2 of the gate 1 is supported by the lower pulleys 4 while the upper support rod 3 is snugly engaged by the upper pulleys, so that if the fingers of a gate operator or a spectator are caught between any pulley periphery and the supporting rod, a crushing force will be imparted to such fingers. More importantly, it should be noted that if, in the operation of the gate, the top support rod 2 of the gate is inadvertently deformed particularly in a vertical direction, the upper support rod 2 can become disengaged from the upper pulleys 4, resulting in the complete disengagement of the gate or the wedging of the gate in an inoperative position.

To overcome these problems, a gate guard 10 embodying this invention is provided as illustrated in FIGS. 3-6. Such gate guard comprises a generally U-shaped housing 12 having an open bottom end 12*a*. Housing 12 is made up of a rear vertical wall 14, a front vertical wall 16 and a peripheral wall 18. The rear wall 14 is designed to be positioned intermediate the pulley 4 and the supporting post 7. Rear wall 14 is provided with a downwardly open vertical slot 14*a* to surround the stub shaft 5 upon which the pulley 4 is mounted for rotation.

The front wall 16 of the housing 12 is solid, but may be provided with a relatively small opening 16*a* adjacent the hub portion of the pulley 4 to permit the nozzle of a grease gun to be inserted through such opening to engage a grease fitting (not shown) commonly provided on the hub portion of the pulley 4.

The peripheral wall 18 has a semi-circular top 18*a* and vertically extending end portions 18*b* and 18*c*. Such end portions extend below the perimeter of the pulley 4. Each end portion 18*b* and 18*c* is respectively provided with a downwardly open vertical slot 18*d* which surround the support rod 2 with which the pulley 4 is engaged.

Rear wall 14 has a horizontally projecting flange 20 welded thereto and such flange provides a mounting for one or more clamp elements 22 which surround the fixed post 8 and are rigidly secured to flange 22 by bolts 24. Thus the pulley guard, once installed, will remain in its aforedescribed position relative to the pulley 4 and the cooperating gate support rod 2.

It will be readily apparent from the foregoing description, that it is virtually impossible to have inadvertent finger contact with the periphery of any gate pulley. If the gate operator, or a spectator, has his hand resting on the support rod 2, generally the upper support rod 2, his hand will abut the lower vertical portion 18*b* or 18*c* of the housing wall 18 if the gate is moved, and thus prevent his fingers from becoming engaged between the pulley periphery and the gate support rod 2. Furthermore, the extension of the lower portions of the pulley guard 10 below the periphery of the pulley 2 provides additional assurance that the pulley will not be disengaged from the support rod 2 in the event the upper or lower support rods are deformed.

Thus, the common problems encountered in the operation of modern industrial type sliding gates have been substantially eliminated through the provision of the pulley guards embodying this invention.

Although the invention has been described in terms of specified embodiments which are set forth in detail, it should be understood that this is by illustration only and that the invention is not necessarily limited thereto, since alternative embodiments and oeprating techniques will become apparent to those skilled in the art in view of the disclosure. Accordingly, modifications are contemplated which can be made without departing from the spirit of the described invention.

What is claimed and desired to be secured by Letters Patent is:

1. In a slidable gate construction having a horizontally disposed gate support rod guided by a pulley rotatably mounted on a horizontal stub shaft secured to a fixed vertical post, the improvement comprising:

a rigid safety housing having an open bottom, horizontally spaced, vertical side walls with semi-circular top portions and a transverse wall secured to the peripheries of said side walls, said housing being mountable in surrounding relation to the upper peripheral portions of said pulley;

the vertical portions of said transverse wall having downwardly facing semi-circular notches in their lower ends surrounding said gate support rod; and means for rigidly mounting said safety housing to said fixed vertical post, whereby said safety housing prevents inadvertent finger engagement between said pulley and said gate rod, said means for rigidly mounting said safety guard comprising a projection formed on the vertical side wall of said safety guard intermediate said pulley and said fixed vertical post; and clamping band means for surrounding said fixed vertical post and bolted securement to said projection.

2. In combination, a fixed vertical post mounting a horizontal stub shaft;

a gate pulley having a grooved periphery mounted for rotation about said horizontal stub shaft;

a gate having an elongated guide rod cooperating with said grooved periphery of said gate pulley to guide longitudinal movements of said gate;

a hollow safety guard housing surrounding said pulley from its top periphery to a region below the axis of said gate guide rod;

said safety guard housing having inner and outer vertical walls respectively lying adjacent the side walls of said pulley;

said inner vertical wall having a downwardly open slot surrounding said stub shaft;

said outer vertical wall being substantially solid;

an inverted U-shaped enclosing wall rigidly secured to the peripheries of said vertical inner and outer walls, thereby preventing inadvertent contact of fingers with the grooved periphery of said pulley;

means for rigidly securing said housing to said fixed vertical post, said means for rigidly mounting said safety guard comprising a projection formed on the vertical side wall of said safety guard intermediate said pulley and said fixed vertical post; and clamping band means for surrounding said fixed vertical post and bolted securement to said projection.

* * * * *